United States Patent [19]

Schwab et al.

[11] 4,321,843

[45] Mar. 30, 1982

[54] PROCESS FOR THE PRODUCTION OF DRAWING DIE BORES

[75] Inventors: Max Schwab; Peter Heinen; Willi Diederichs; Peter Gossens; Fritz-Gunter Ohloff; Hubert Minkenberg, all of Heinsberg, Fed. Rep. of Germany

[73] Assignee: Akzo, N.V., Arnhem, Netherlands

[21] Appl. No.: 36,975

[22] Filed: May 8, 1979

[30] Foreign Application Priority Data

May 8, 1978 [DE] Fed. Rep. of Germany ..... 2820018
May 8, 1978 [DE] Fed. Rep. of Germany ..... 2820019

[51] Int. Cl.[3] ..... B24B 1/00

[52] U.S. Cl. ..... 76/107 A; 76/4; 51/48 R; 125/30 WD

[58] Field of Search ..... 76/107 R, 107 A, 4; 51/44, 46, 48 R, 50 R, 281 R, 318, 326; 125/30 WD

[56] References Cited

U.S. PATENT DOCUMENTS 1,367,686 2/1921 Connor et al. ..... 76/4
3,592,084 7/1971 Gelfand ..... 76/4

FOREIGN PATENT DOCUMENTS 416809 7/1925 Fed. Rep. of Germany .
445958 7/1927 Fed. Rep. of Germany .
527000 6/1931 Fed. Rep. of Germany .
560176 9/1932 Fed. Rep. of Germany .
592406 2/1934 Fed. Rep. of Germany .
2416717 10/1975 Fed. Rep. of Germany .
2419660 11/1975 Fed. Rep. of Germany .

*Primary Examiner*—Roscoe V. Parker
*Attorney, Agent, or Firm*—John H. Shurtleff

[57] ABSTRACT

A process for the production of drawing die bores, especially in hard metal or carbide wire drawing dies, wherein each bore has an inlet cone portion on the feed side of the die and a cylindrical calibrating portion along a common axis, the process being a two-step grinding and finishing procedure with a cross-grinding of the inlet cone in a first step and a calibrating grinding and finishing of the cylindrical portion in a second step. Especially preferred apparatus is described for each of these steps, with devices to operate in an automatic or semi-automatic manner to manufacture the finished drawing dies.

13 Claims, 8 Drawing Figures

PROCESS FOR THE PRODUCTION OF DRAWING DIE BORES

BACKGROUND OF THE INVENTION

This invention relates to a process for the production of drawing die bores, preferably in the finishing of hard metal drawing dies with existing crude bores. It further relates to apparatus for carrying out the process of the invention. Such dies are useful in wire drawing, i.e. for the reduction of a rod or wire by pulling it through a round aperture of a die to reduce its diameter while increasing its length.

It is customary in order to facilitate the finishing of drawing die bores to first introduce draw channels into the workpiece with its production. The diameter of these channels is regulated in such a way that for the calibration of the bores and for the achievement of a sufficiently smooth bore surface, the channel diameter exhibits a sufficiently large undersize. This draw channel is coproduced in the production of the initial drawing die as an unfinished piece and is designated as the crude bore.

Many references are known in which devices for the finishing manufacture of drawing dies are described. All of these devices essentially work according to the same principle but have one substantial disadvantage. Either the progress of the drawing die manufacture must be very precisely supervised in order to achieve the desired final size with the required narrow tolerance or, in the introduction of a cylindrical wire together with an abrasive into the drawing die bore for the finishing of the cylindrical bore part, the finishing must take place in small steps in such a way that the widening of the bore is never greater than the corresponding abrasive grain being used.

Thus, for example, German patent specification (DE-PS) No. 445,958 describes a drawing die finishing machine in which an inlet cone and cylindrical bore part of a drawing die may be finished. In this machine, the work tool and workpiece holder are arranged coaxially. The workpiece holder is moved in rotation while the work tool holder performs oscillating movements in axial direction. A substantial disadvantage here is the fact that the conically shaped working surface of the work tool makes definite contact with the surface to be finished only at its lowermost position. Moreover, finishing marks running in circumferential direction on the cone surface are unavoidable. Besides, an exact control of the progress of the work and of the accuracy of bore size is possible only by stopping the machine, something which requires a considerable loss of time.

In order to meet one of the disadvantages noted for the finishing of inlet cones, namely the unfavorable proportion of working time to idle time of the "needle" used as the work tool, it has been variously suggested that the work tool holder be made tiltable about the narrowest point of the finished cone as the turning point (DE-PS No. 527,000; DE-PS No. 560,176; DE-OS No. 2,419,660), so that the conical or even the cylindrical surface of the work tool lays regularly on the cone surface. In this manner, it is also known (DE-PS No. 416 809) to additionally press the work tool by means of a spring force onto the cone surface.

Even with these processes for the production of the inlet cone in drawing die bores, substantial difficulties are unavoidable such as finishing grooves and time-consuming checks on the working progress.

A somewhat different finishing means is described in German patent specification (DE-OS) No. 2,416,717. The work tool holder and the work piece holder rotate here in opposite directions. A calibrating, pointed wire serves as the work tool. For the cone finishing, the work tool axis is tilted. The work tool and work piece remain in uninterrupted contact with each other. After penetration of the drawing die bore, the work tool touchs a contact arranged below the drawing die, whereby the operation is stopped.

Here also a substantial disadvantage occurs in that one cannot achieve an unobjectionable surface free of finishing grooves in circumferential direction. Besides, this process is possible, due to the inclined position of the work tool, only in a production of the inlet cone wherein the diameter of the cylindrically bored portion considerably exceeds that of the work tool.

To be sure, an attempt has been made (DE-PS No. 592,406) to avoid some of the described disadvantages of known devices for the production of the cylindrical bore part. In this case, the drawing die is clamped in a rotating workpiece holder and, coaxially to this, a work tool in the form of a cylindrical calibrating wire pointed at its working end is arranged in a work tool holder and is placed in oscillating movement in axial direction. In order to remove or erode the work surface, the wire used with an abrasive material is continuously moved against the workpiece in longitudinal direction. With this device, it is possible to achieve a larger diameter expansion per work tool, but the adjustment of the work tool movement in eroding material from the bore is so difficult to accomplish that it very frequently results in the twisting off of the very thin wire. It has been common therefore to undertake the final finishing of very fine drawing die bores by hand, something which is very complicated and requires a considerable expenditure for hand labor.

SUMMARY OF THE INVENTION

It is a basic object of the present invention to provide a process and corresponding apparatus for carrying out the process for the production of drawing die bores, whereby the above-described disadvantages in the prior art may be avoided and particularly so as to provide a working process which is substantially free of operational disturbances and which may be partly or completely automatic. It is a specific object of the invention to provide such a process and apparatus wherein the die bore is ground and finished so as to be properly calibrated and substantially free of finish traces, i.e. groove marks or similar surface imperfections, and without any breakdown or interruptions taking place during each run due to damage of the work tool. It is also an object of the invention to provide a grinding and finishing process and apparatus especially suitable for the production of hard metal drawing dies used to manufacture drawn metal wires, e.g. beginning with a workpiece or blank which is already provided with one or more crude bores, the present invention providing a final grinding and finishing operation with calibration of the bore to provide the desired wire diameter.

It has now been found, in accordance with the invention, that these and other advantages can be achieved, especially in the production of finished bores in a hard metal drawing die workpiece having crude bores, preferably using a two-step grinding and finishing procedure of first cross-grinding an inlet cone of the die in a first step and then calibrating a cylindrical part of the die in a separate second step.

The process of the invention further includes uniformly grinding and finishing the inlet cone in the first step by means of a grinding tool which is radially deflectable in the bore within defined limits, rotating said tool and the die workpiece in the same direction but at different rotational speeds while also oscillating the tool in axial direction with a frequency and amplitude dependent upon the difference in rotational speeds and the final dimensions of the bore, and resiliently pressing the workpiece onto the tool while strongly damping the oscillating movement imparted thereto by said tool.

It is advantageous in this production of the inlet cone to maintain a substantially constant pressure or force of pressing the workpiece onto the work tool during the entire contact phase of the grinding and finishing operation. The amplitude of the axially oscillating work tool movement preferably amounts to about 0.8 to 2.5 mm, and the frequency of the work tool oscillation can be in a range of about 350 to 600 cpm (cycles per minute) or about 6 to 10 Hz (Hertz or cycles per second). It is preferable to select a difference in rotational speed between the work tool and workpiece of about 50 to 150 rpm (revolutions per minute), wherein the ratio of the frequency of the work tool oscillation to the difference in rotation speeds is adjusted to fall in a preferred range of about 3:1 up to about 6.5:1. It is further preferable to choose a rotational speed of the workpiece which is greater than that of the work tool and which is in the range of about 600 to 1,100 rpm.

In the calibration of the cylindrical part of the drawing die bore, it is advantageous in the second step of the invention to carry out the desired grinding and finishing by means of a calibrating tool consisting essentially of a calibrating wire together with an abrasive material, said wire being swingable about its own axis against a counter force, advancing the wire at a prescribed rate of movement in the bore of the die workpiece, reversing this advance movement of the wire as soon as the torque required to secure the wire against twisting exceeds a preset value and then resuming this advance movement again when the torque has fallen below a second preset value which is smaller than said first preset value. The swinging or pivoting of the wire about its own axis occurs only to a limited extent, for example, up to 180° but preferably about 90°–120°, in acting against a counter force such as a suitable spring force or the like. The calibration of the cylindrical bore part is advantageously carried out in two or more stages with the calibrated wires used in each stage being correspondingly graduated, e.g. so as to gradually increase the bore diameter to the final or nominal bore size. One can favorably deal with the monitoring of the torque required to retain or arrest the tool and the reversal of the advancing movement of the bore work tool by means of conventional sensing or transducing devices of a type known per se for sensing the magnitude of the turning or swinging movement of the tool. The sensor then automatically acts through a conventional electrical circuit to automatically control the reversing and advancing movements of the wire tool.

With the process of the invention, it is possible on the one hand to produce inlet cones with the highest measure of precision in drawing die bores, said cones no longer exhibiting hardly any finish markings and therefore being of outstanding surface quality, while on the other hand it is also possible to produce the cylindrical part of the drawing die bore with utmost precision and quality together with optimum care for the work tool.

The finished bores can be produced with a diameter down to as low as about 0.08 mm and without any upward limit on the bore size other than economical considerations, e.g. up to about 2–3 mm. For wire drawing dies, the invention is especially useful in preparing finished drawing bores with a diameter in the range of about 0.12 up to about 1.5 to 2 mm.

In the production of the inlet cone, different tool working directions are achieved through the adjustment of the stroke path, stroke frequency and relative rotational speed, whereby the direction of the work tool in the sinking or inward stroke and that in the withdrawal or outward stroke efficiently intersect each other, i.e. to provide a desirable "cross-grinding" effect preventing undesirable grooving or visible finish marks. Care is taken to provide a lateral degree of freedom of the work tool such that the conical point of the tool, adapted in its generating angle to that of the inlet cone, lies against the cone surface over a greater part of its grinding stroke. Moreover, by lopping or cutting off the point of the work tool so as to provide a definite end diameter of the point in connection with the electrical contact means below the drawing die piece, as known per se, it is possible to exactly adjust the length of the cylindrical bore which follows the inlet cone.

In a preferred embodiment of the apparatus in calibrating the cylindrical bore part, it has been found useful to employ a turret head with two or more boring wires which are graduated in diameter in a suitable manner to permit gradual enlargement of the bore. For example, the turret head may have three or four work tool holders which are lined up in each case with a work tool in the form of a boring wire. For the production of very fine bores, for example, those with a nominal diameter in the range of about 100 to 1,500 microns, it is usually sufficient to use two or three wire bores correspondingly graduated in their diameter. Thus, for example, the still unfinished crude bore of the drawing die inset blank or working piece has an initial diameter of the cylindrical part of about 86–90% of the final diameter of the finished piece. The three boring wires, used for example to finish the cylindrical bore part, preferably have diameters graduated in such a manner that they respectively exhibit about 95.0%, 98.5% and 99% of the desired final bore diameter. The diameter of the last boring wire in each instance is preferably about 1 to 3 microns smaller than the nominal size of the cylindrical bore part, depending upon the fineness of the abrasive grain conventionally used in this kind of grinding and finishing operation.

The bias or initial spring tension acting against the torque of the work tool is preferably selected so that each boring wire used in the process can be deformed or twisted through torsional stress, but not strained permanently, with maximum deflection of the control vane before the reversing of the stroke movement, for example by about 60°. For example, spiral springs may be used to produce the required initial tension, having a torque or turning movement of about Md=0.9 cN.cm/90° where the bore diameter is 0.15 mm and about Md=10cN.cm/90° where the bore diameter is 1.5 mm. Corresponding intermediate values for this spring torque apply to bore diameters between 0.15 and 1.5 mm. It will be understood that with bores which are smaller than 0.15 mm or larger than 1.5 mm in diameter, correspondingly smaller or larger turning moments are chosen.

In operations with automatic or semi-automatic machines, a different maximum feed path or length of tool traverse is employed in the finishing of the cylindrical bore part, as needed for each individual work tool in the turret head, in such a manner that in reaching the particular end position, the turret head moves upwardly or away from the workpiece until the work tool comes free from the bore, wherupon the next work tool is swing or revolved into its working position and the new finishing operation commenced. After withdrawing the last in the series of work tools of the turret head, the drive for the work piece holder is stopped, whereupon, preferably in fully automatic operation, there takes place an ejection of the finished die and a loading or insertion of the new die workpiece with subsequent renewed start of another run of the machine. It can be especially advantageous if the boring wires are kept increasingly long with increasing diameter, in order to thereby make certain that an exactly cylindrical bore exists with great precision upon reaching the final bore size. In this case, the maximum traverse or feed for the individual work tools of the turret head can also be correspondingly different. The points of the wires are advantageously obtained in an electrolytic manner, e.g. in a 10% aqueous NaCl solution. The preparation of such work tools is generally well known.

Since the work tools, e.g. in the form of needles, wires, rods or the like, have a more or less smooth surface, the wearing away of the material takes place with the aid of a so-called boring paste or abrasive. This abrasive is introduced into the inlet cone of the die bore being ground and finished prior to starting up the working position and is sufficient as a rule for completing the working run. In order to prevent centrifuging off of the abrading paste due to the rotation of the die piece, the maximum rotational speed is preferably chosen as dependent upon the die piece diameter and correspondingly the consistency of the abrading paste.

As the abrasive agent, for example, a 3-micron diamond paste dispersed in "Diaplastol", i.e. a suitable liquid medium, can be used. Here, it has been proven that due to the constantly reciprocating feeding and withdrawing movement, a one time addition of the abrasive before the beginning of the work is sufficient to complete each run.

Suitable apparatus for carrying out the process of the invention will be apparent from the detailed description below, including the claims.

THE DRAWINGS

The invention is further explained by means of the accompanying drawings wherein preferred embodiments of the apparatus are illustrated in partly schematic form and wherein.

Figure 2:
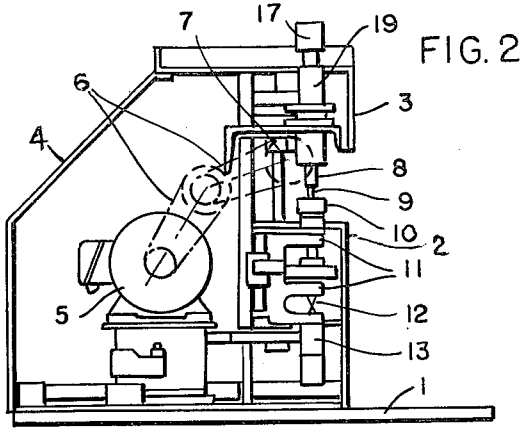
FIG. 2 is a side view of the apparatus used for the production of the inlet cones.
Figure 1:
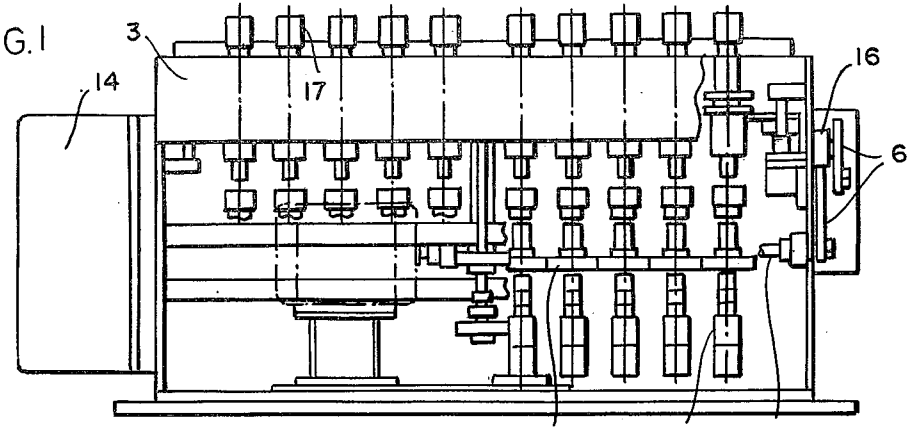
FIG. 1 is a front view of a grinding and finishing apparatus according to the invention with multiple work positions.
Figure 5:
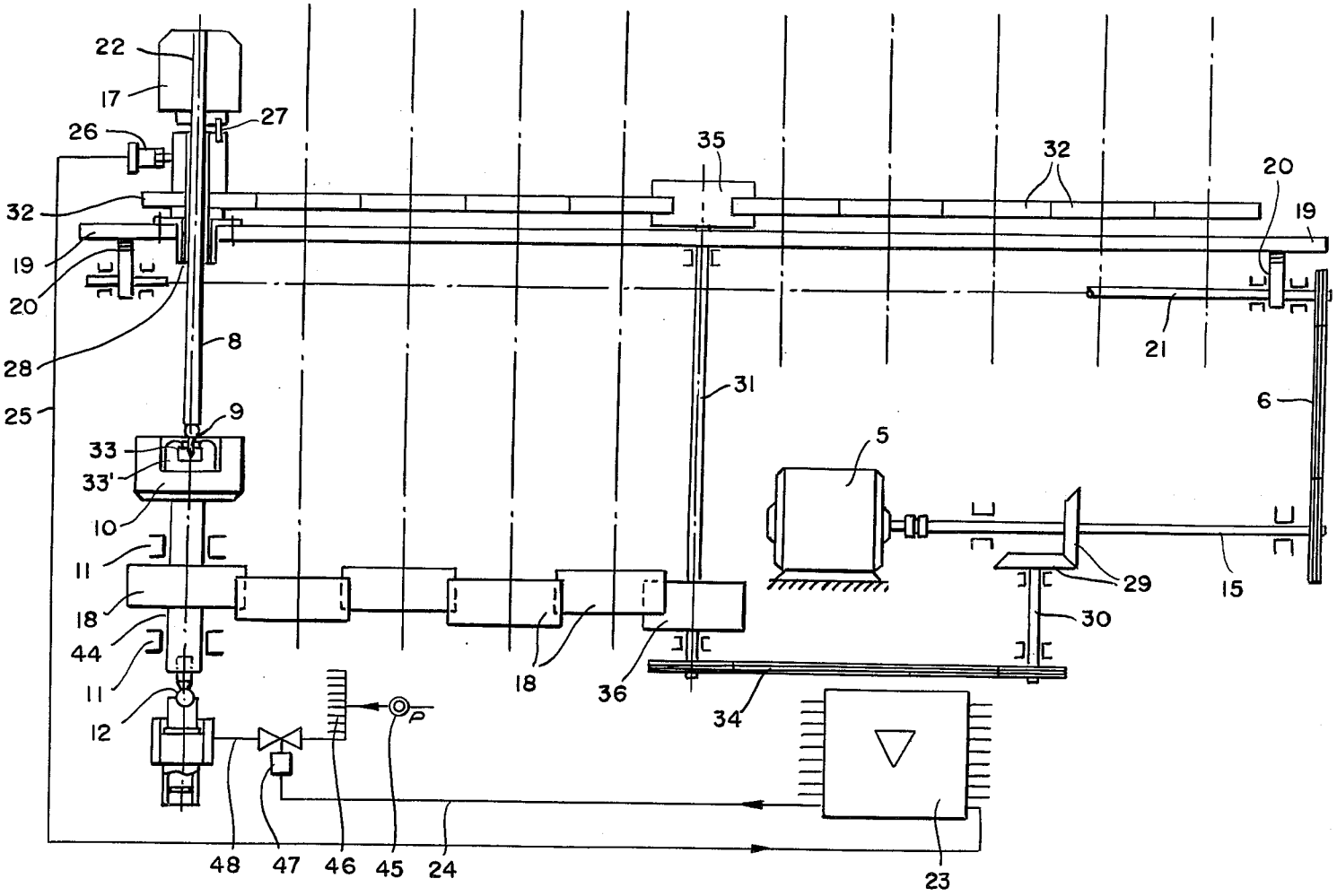
FIG. 5 illustrates the scheme of a multi-position grinding and finishing apparatus for the production of the inlet cone as in FIG. 2.

Referring first to FIGS. 1, 2 and 5, there is shown an apparatus according to the invention equipped with five individual working positions for the production of inlet cones in drawing dies. The entire machine is mounted on a base plate 1 and is covered all around up to the individual working positions, which must remain accessible, by means of acrylic glass plates 2, 3 and 4.

As a common drive means, there is provided a drive motor 5 which acts over a distibutor gear or similar transmission means to drive the work tool spindle 22, the workpiece spindle 44 and the cam or eccentric means 20 which rotates to produce the oscillating movement of the work tool 9. The drive shaft 15 is connected over a bevel gear transmission 29 having a further drive shaft 30 which in turn is connected over the geared belt drive 34 with the central shaft 31.

The free end of the drive shaft 15 operates the cam shaft 21 over a further gear belt transmission 6, a cam 20 being fastened onto this shaft at both ends of the machine in order to alternate or place in motion with a vertical oscillating movement the spindle rail 19, preferably against a spring tension. The spindle rail 19 carries the boring units which in each case consist of the work tool holder 8 with its work tool 9 positioned on a bore spindle 22 at the lower end thereof, a flanged tool carrier or mounting device 28 for the bore spindle 22 to which it is attached for common rotational and oscillatory movement, and a weight or loading member 17. The bore spindle 22 with the tool holder 8 and the work tool 9 are seated to fit loosely in the carrier 28 in such a manner that they can execute slight lateral movements, i.e. radially of the boring axis, the bore spindle being operatively connected for rotation over a coupling pin 27 with the drive gear transmission including gear wheel 32. With this arranagement, by making an accurate choice of the oscillating frequency of the spindle rail 19, the weight 17 is sufficient to permit these elements to follow the cam movements. Where this weight is not sufficient by itself to guarantee cam following movements, it is possible to load the spindle rail 19 at both ends, e.g. in each case with a suitable compression spring in order to ensure constant contact seating of the spindle rail 19 on the cam 20.

It has become clear that with the different drive of the bore spindle 22 and the workpiece spindle 44, the process of the invention depends upon the difference in rotational speed and not upon the direction of rotation as long as both spindles of a given working position rotate in the same direction. For this reason, in the embodiment of the apparatus of the invention which is illustrated schematically in FIG. 5, it is possible to arrange in a simple manner for both the gears 32 and also the gears 18 to mesh into each other so that the adjacent working positions each rotate in opposite directions. In every case, however, the rotational speed difference (as pedetermined in combination with the correspondingly chosen frequency of the work tool oscillations) is equal in its magnitude so that the uniform quality of all of the finished surfaces is guaranteed.

Figure 4:
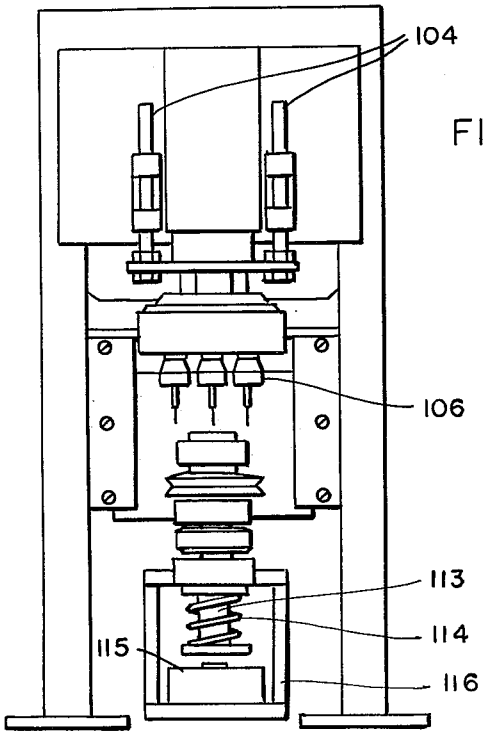
FIG. 4 is a front view of the same apparatus as FIG. 3.
Figure 3:
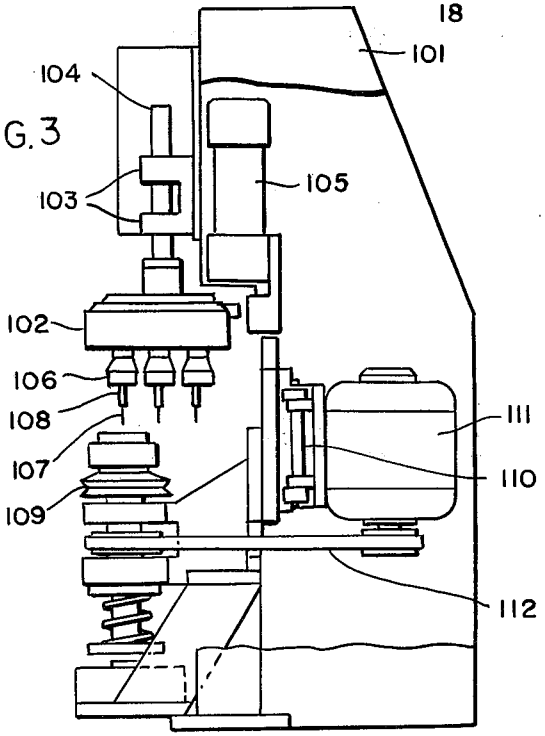
FIG. 3 is a side view of the apparatus for calibrating the cylindrical bore parts.

In the calibrating apparatus of FIGS. 3 and 4 (see also FIGS. 7 and 8), there is movably mounted on the machine upright or frame 101 the turret head 102 carrying the individual boring heads 106, the movement of the turret head being assisted by means of the guide bars 104 which run in the bearing brackets 103. Each boring head 106 has its own work tool holder 108 and a work tool 107. The turret head 102 is held on the machine frame in such a manner that each work tool located in a working position is situated on the axis of the drawing die bore. The drive motor 105 is used to rotate or swivel each boring head into its operating position.

Under the turret head 102 and placed such that its axis coincides with that of the work tool holder 108 situated in the working position, there is arranged a means for clamping or holding the drawing die workpiece 124. This holding means consists of a supporting device 109 for a collet 123 in the form of a flanged socket adapted to receive the workpiece, a hydraulic cylinder 115 with suitable piston means protruding upwardly therefrom for putting the collet 123 into operation against a spring 114, and a drive pulley 122 mounted on the supporting device 109 for the drive of the collet 123. A motor 111 is connected over the belt 112 with the belt pulley 122. This motor 111 is fastened onto a swivel or hinge joint 110 (FIG. 3) in such a manner that it can be swivelled to tension the belt 112. The framework 116 fastens the piston-cylinder 115 in place under the spring extended position of the rotatable working spindle 113.

Figure 8:
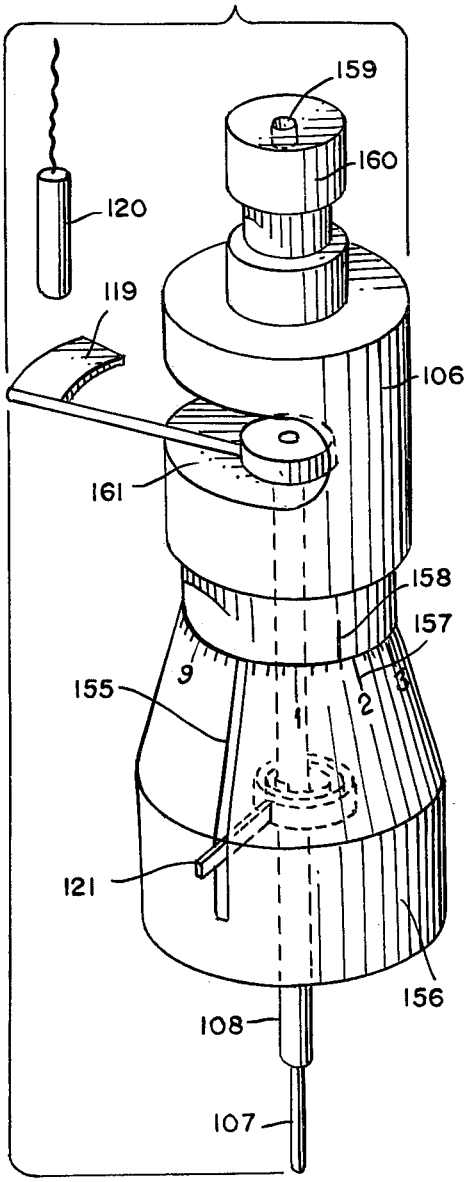
FIG. 8 shows one embodiment for monitoring the torque necessary to restrain the work tool and suitable means for reversing the feed direction.
Figure 7:
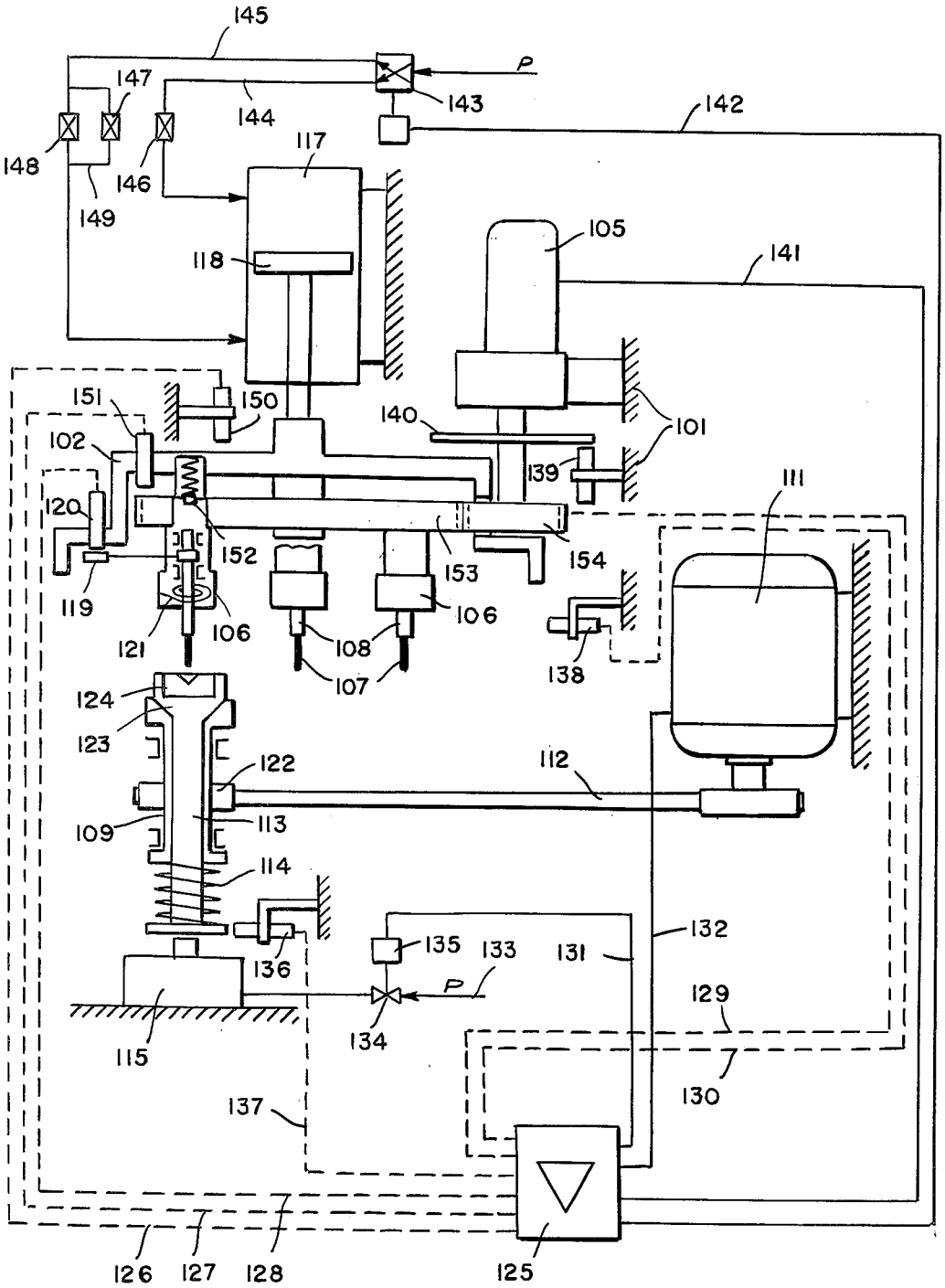
FIG. 7 represents the practical operating diagram of an apparatus for the calibration of the cylindrical bore part of the drawing die.

From the diagram illustrated in FIG. 7, taken with FIGS. 3, 4 and 8, the mode of operation of the device will be apparent. The principle item used to control automatic or semi-automatic operation of the apparatus is the electronic control unit 125. It is connected with all of the functional positions of the apparatus according to the invention by means of the corresponding control lines 126 to 132, inclusive, and 137, 141 and 142.

A drawing die blank or workpiece 124 is inserted in the collet 123 and the first boring work tool 107 is swivelled into working position. In turning on the machine, the working spindle 113 with the die workpiece 124 is placed into rotating movement. The downward movement of the turret head 102 is initiated by means of the lift cylinder 117 with its piston 118 which can advance the work tool into the workpiece or retract it again. For this purpose, compressed air "p" is admitted through the 4/2-directional control valve 143 and line 144 over a velocity modulating throttle 146. Thereby, the work tool 107 is lowered into the crude bore of the drawing die workpiece 124 which has been provided with a suitable abrasive boring paste.

Due to the oversize of the boring work tool in comparison to the crude bore or existing bore of the die workpiece, it is unavoidable that the torque set up by lowering or advancing of the work tool into the bore is substantially increased until the work tool twists against the action of the spring 121 in the rotational direction of the drawing die and thereby takes along the vane 119 which turns therewith. This vane thereby falls outside of the effective range of the sensor device 120, a so-called "proximity initiator" or "approach switch" 120, i.e. any sensing means capable of producing an electrical signal in response to the approach and/or the withdrawal of an activating member such as vane 119. The pulse or electrical signal produced in this manner is converted in the control device 125 into a reversing switch command signal for the 4/2-directional valve 143 which is then positioned to introduce compressed air "p" through lines 145 and 149 and both throttle valves 147 and 148 to act on the lower part of the lift cylinder 117, 118. The upward movement of the piston 118 causes the work tool 107 to be loosened and withdrawn axially from the working position so that it is released from the torque applied by the workpiece, and the control vane 119 turns back to arrive again in the effective range of the proximity initiator 120. This movement of the vane 119 initiates another reversal of the 4/2-direction valve 143, and the work tool 107 is lowered again into the drawing die bore. These reversing signals or reversing switch commands occur in relatively rapid alternation, e.g. about 20–100 per minute, thereby simultaneously causing a constant supply of new abrasive paste to be applied along the working position, i.e. onto the surface being finished.

If the first work tool pushes through the drawing die bore so that the turret head 102 arrives at the effective range of the proximity initiator 138 which senses the lower end position of the turret movement, the signal produced thereby first causes the turret head to be brought with rapid motion into its upper end position through suitable control of the valve 143 and the throttle valve 147. This upper end position is noted by the initiator 150 which provides a suitable signal to the control switching unit 125. The drive motor 105 is then switched on in order to turn the turret head 102 by about 90 degrees by means of the gear 154 which meshes with the gear 153 fastened onto the turret head and carrying the boring heads 106, thereby bringing the second boring tool 107 into working position. The swinging or turning movement of the gear 153 carrying the boring head is limited with the aid of a proximity initiator or approach switch 139 and a control disk 140 which carries a recess or cutout on its circumference, the appearance of which causes a signal generated in the initiator 139 to stop the turning procedure of the turret. When this point is reached, a spring loaded ball 152 engages in a corresponding cavity as a catch or locking means to guarantee an exact centering of the work tool.

After moving a new work tool 107 into position, the lowering or advance of this tool into the bore of the die piece is initiated and the boring operation proceeds in the same manner as described above.

When the last tool is again drawn out or drawn back from its lower or inner end position where the tool has pushed through the die, then it is possible, if desired, to swivel or pivot the first working tool 107 back into the working position, and in any case, to provide a signal for stopping the machine through a suitable marking or cueing means on the gear 153 which can be sensed by the proximity initiator 151. In addition, this signal may be used for the ejection of the finished drawing die 124 from the collet 123 with the help of the piston-cylinder 115 which is acted upon with compressed air "p" admitted through line 133 and the solenoid valve 134.

Figure 6:
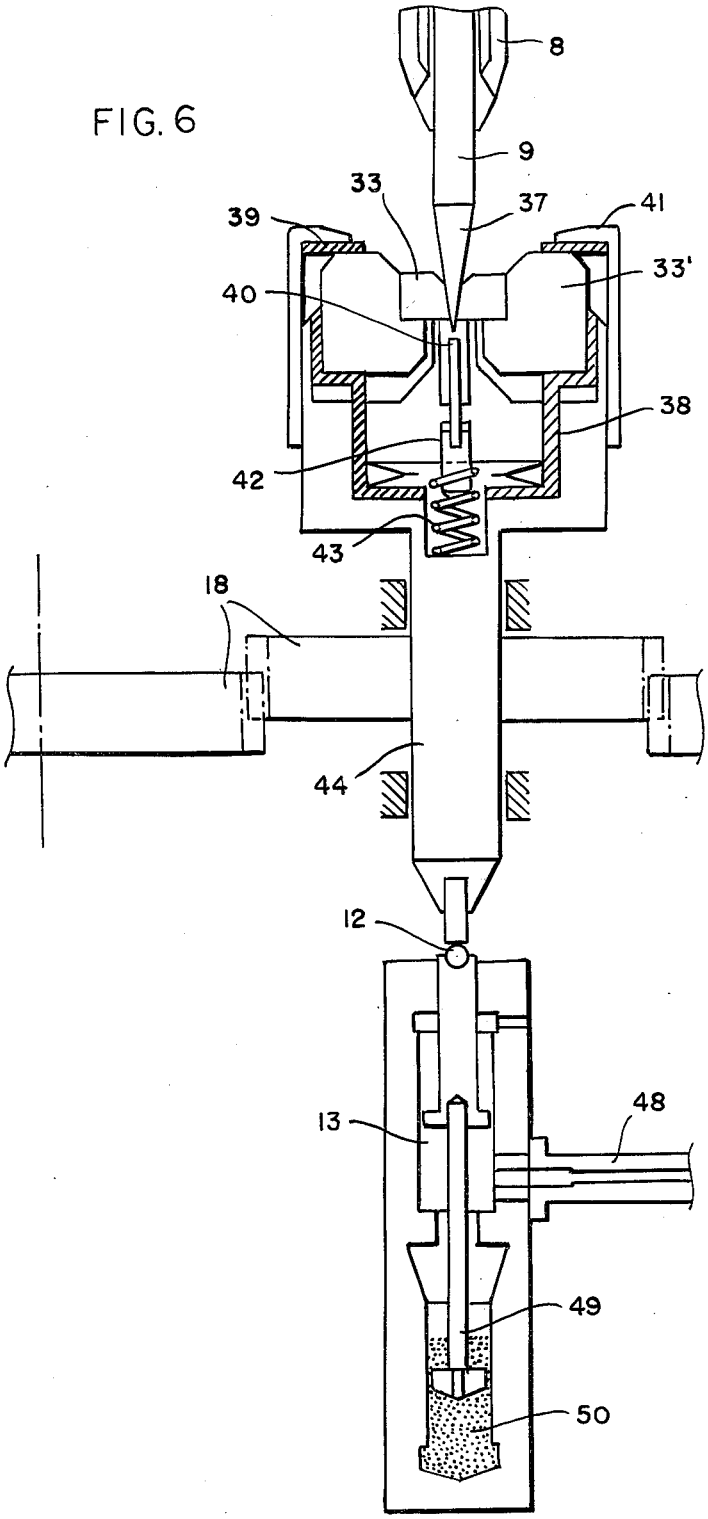
FIG. 6 is a schematic illustration of one of the individual working positions of FIG. 5.

A working position for production of the inlet cone according to the invention is illustrated in FIG. 5 and in FIG. 6 on an enlarged scale. The tool 9 fastened in the tool holder 8 has a conical working point 37 whose angle of taper is matched to the desired angle of taper of the inlet cone. The point 37 is cut off at its forward end to an exactly preset diameter. In a supporting device or holding fixture 10 situated at the upper end of the workpiece spindle 44, there is seated an insulating drawing die holder which consists of the actual drawing die receptacle 38, the cover plate 39 and the clamping cap 41. The drawing die, which consists of the actual die element itself 33 as an inset and the die casing 33', is seated so as to be electrically insulated or sealed in the holding fixture 10. In the center of the holding fixture 10 and below the die element 33 there is located on the axis of the drawing die bore a contact pin 40 which interacts with the tool point 37. The height of the upper end of the contact pin 40 can be adjusted with the help of the threaded rod 42, whereby the spring 43 provides a reliable electrical connection between the threaded rod 42 with contact pin 40 and the workpiece spindle 44.

Below the workpiece spindle 44 is situated a pneumatic feeding unit 13 whose movements are so strongly damped by means of a hydraulic damping device 13 acting on the piston rod 49 in the piston of the pneumatic feeding unit 13, that a constantly uniform force against the boring needle 9 is incapable or practically incapable of taking part in the oscillating movements of the boring needle 9. In order to achieve therein a constant contact pressure of the drawing die 33 on the boring needle 9, the pressure in the pneumatic feeding unit 13 is kept constant in a narrow range with the help of a pressure reducing station. The force influence of the piston of the hydraulic feeding unit takes place on the workpiece spindle 44, which is axially movable, over a ball 12.

The working tool 9 is non-conductingly supported in the tool carrying device 28 and is connected over a contact brush 26 at the upper end of the workpiece spindle 22 with an electrical control unit 23. The contact pin 40 arranged below the drawing die bore is connected for its part with the electrical control unit 23 over the machine frame. If the machine operation has proceeded so far that the boring needle 9 with its point 37 touches the contact pin 40, then the solenoid valve 47 is reversed over the control unit 23 and evacuates the part of the pneumatic cylinder 13 lying below the pneumatic piston. By this means, the workpiece spindle 44 settles into its lower position. When all of the workpiece spindles 44 have descended, the drive motor 5 is switched off and the completed drawing die can be removed.

FIG. 8 taken with FIG. 7 illustrates a boring head in a simplified schematic view. Its upper part 106 is fastened onto the gear wheel 153 of the turret head by means of the clamping peg or boss 160 having a central bore 159. Its lower half is bored through to receive the tool holder 108. The bore ends at a transverse recess or opening 161 in which the control vane can move freely in its swinging movements. At the lower rim of the upper portion of the boring head 106, rotably thereto, is arranged an adjusting ring 156. This has on its end lying next to the upper part 106 an adjusting scale 157, besides being provided with a slot 155 for receiving the freely movable arms of the spiral spring 121. By rotating the adjusting ring 156 opposite the boring head upper part 106, using the reference mark 158 as a means of orientation, the magnitude of the torque or turning moment can be adjusted with fine sensitivity to achieve the torque load required before the vane 119 swings or pivots out of the effective range of the proximity initiator 120.

In the production of the inlet cone, it has been found to be exceedingly important for the quality of the finishing surface to coordinate the difference of rotational speed as between the tool and the workpiece with the oscillating frequency within the limits set according to the invention. For example, it has been determined that cones with an excellent surface without any finish marks can be attained if the following operating conditions or settings are used:

Boring needle: 700 rpm
Die workpiece: 800 rpm
Stroke frequency: 460 cpm
Stroke amplitude: 1.5 mm The abrasive particle size under these tested conditions was 0.5–3.0 microns, and the viscosity of the abrasive paste amounted to about 5–20 poise.

For the effectiveness of the process according to the invention, it is of no particular significance whether the work tool, e.g. the boring needle, or the drawing die workpiece rotates with the higher turning speed. It is the difference in the rotational speed in combination with the selected stroke frequency which is of importance, the values given in the example set forth above lying within the scope of the ranges taught by this invention. In general, these values are selected to provide an optimum cross-grinding which substantially completely avoids finishing marks. It can be of advantage to rotate the die workpiece at the higher speed. On the other hand, the consistency of the abrasive agent can be chosen such that at relatively higher workpiece speeds a centrifuging or flinging off of the abrasive substance does not occur.

In general, it has been established that drawing die bores according to the process of the invention can be made in an automatic or semi-automatic operation free of any danger of breakage of the work tools or the production of finishing marks on the completed bores.

The invention is hereby claimed as follows:

1. In a process for the production of drawing die bores in which each bore has an inlet cone part and a cylindrical part along a common axis, the improvement comprising a two-step grinding and finishing procedure of cross-grinding the inlet cone in a first step and then calibrating the cylindrical part in a separate second step, wherein a uniform grinding and finishing of said inlet cone is carried out in the first step by means of a grinding tool which is radially deflectable in the bore within defined limits, rotating said tool and the die workpiece in the same direction but at different rotational speeds while also oscillating said tool in axial direction with a frequency and amplitude dependent upon the difference in rotational speeds and the final dimensions of the bore, and resiliently pressing said workpiece onto the tool while strongly damping the oscillating movement imparted thereto by said tool.

2. A process as claimed in claim 1 wherein said resilient pressure of said workpiece onto said tool is applied substantially uniformly during the entire contact phase of grinding and finishing the cone part in said first step.

3. A process as claimed in claim 1 wherein the amplitude of said axial oscillating movement is about 0.8 to 2.5 mm.

4. A process as claimed in claim 1 wherein the frequency of the work tool oscillation is about 350 to 600 cpm.

5. A process as claimed in claim 1 wherein the difference in rotational speed between the work tool and workpiece is adjusted to about 50 to 150 rpm.

6. A process as claimed in claim 1 wherein the ratio of the frequency of the work tool oscillation to said difference of rotational speeds is in a range of about 3:1 to about 6.5:1.

7. A process as claimed in claim 1 wherein the rotational speed of the workpiece is greater than that of the work tool and is selected in a range of about 600 to 1,100 rpm.

8. A process as claimed in claim 1 wherein said amplitude is about 0.8 to 2.5 mm, said frequency is about 350 to 600 cpm, and said difference of rotational speeds is about 50 to 150 rpm.

9. A process as claimed in claim 8 wherein the ratio of the frequency of the work tool oscillation to said difference of rotational speeds is about 3:1 up to about 6.5:1.

10. A process as claimed in claim 9 wherein the rotational speed of the workpiece is greater than that of the work tool and is selected in a range of about 600 to 1,100 rpm.

11. In a process for the production of drawing die bores in which each bore has an inlet cone part and a cylindrical part along a common axis, the improvement comprising a two-step grinding and finishing procedure of cross-grinding the inlet cone in a first step and then calibrating the cylindrical part in a separate second step, wherein the grinding and finishing of the cylindrical part in the second step is carried out by means of a calibrating tool consisting essentially of a calibrated wire together with an abrasive material, said wire being swingable about its own axis against a counterforce, advancing said wire at a prescribed rate of movement in the bore of the die workpiece, reversing said advance movement of the wire as soon as the torque required to secure the wire against twisting exceeds a preset value and then resuming said advance movement again when the torque has fallen below a second preset value which is smaller than said first preset value.

12. A process as claimed in claim 11 wherein the calibration of the cylindrical part of the bore in the second step is carried out in a plurality of stages.

13. A process as claimed in claim 11 wherein said first and second preset values of torque are monitored by a sensor which automatically acts to control the reversing and advancing movements of the wire tool.

* * * * *